US008944211B2

(12) United States Patent
Blaska

(10) Patent No.: US 8,944,211 B2
(45) Date of Patent: Feb. 3, 2015

(54) RETRACTABLE LADDER

(76) Inventor: Richard C. Blaska, San Francisco, CA (US)

( * ) Notice: Subject to any disclaimer, the term of this patent is extended or adjusted under 35 U.S.C. 154(b) by 193 days.

(21) Appl. No.: 13/408,929

(22) Filed: Feb. 29, 2012

(65) Prior Publication Data

US 2012/0222915 A1 Sep. 6, 2012

Related U.S. Application Data

(60) Provisional application No. 61/448,961, filed on Mar. 3, 2011.

(51) Int. Cl.
*E06C 9/00* (2006.01)
*E06C 9/08* (2006.01)
*E06C 7/50* (2006.01)

(52) U.S. Cl.
CPC .. *E06C 9/08* (2013.01); *E06C 7/505* (2013.01)
USPC ..... 182/97

(58) Field of Classification Search
USPC ..... 182/97, 98
See application file for complete search history.

(56) References Cited

U.S. PATENT DOCUMENTS

| | | | | | |
|---|---|---|---|---|---|
| 213,544 | A | * | 3/1879 | Chamberlain | 182/51 |
| 304,821 | A | * | 9/1884 | Hofele | 182/84 |
| 311,239 | A | * | 1/1885 | Evans | 182/21 |
| 887,550 | A | * | 5/1908 | Van Broekhoven | 182/96 |
| 1,015,173 | A | * | 1/1912 | Grunbaum | 182/95 |
| 1,977,706 | A | * | 10/1934 | Watts | 187/401 |
| 2,622,783 | A | * | 12/1952 | Mahoney | 182/89 |
| 2,794,583 | A | * | 6/1957 | Ernst | 182/97 |
| 3,012,633 | A | * | 12/1961 | Magee | 187/279 |
| 3,379,280 | A | * | 4/1968 | Pace | 182/96 |
| 3,575,263 | A | * | 4/1971 | Reinhard | 182/160 |
| 3,601,220 | A | * | 8/1971 | Saucier | 182/84 |
| 3,869,022 | A | * | 3/1975 | Wallk | 182/96 |
| 4,189,028 | A | * | 2/1980 | Reinhard | 182/160 |
| 4,425,983 | A | * | 1/1984 | Reinhard | 182/96 |
| 4,476,957 | A | * | 10/1984 | Ory | 182/21 |
| 4,643,274 | A | * | 2/1987 | Tataseo | 182/106 |
| 5,584,493 | A | * | 12/1996 | Demski et al. | 280/166 |
| 5,655,628 | A | * | 8/1997 | Lin | 187/414 |
| 6,012,545 | A | * | 1/2000 | Faleide | 182/97 |
| 6,116,378 | A | * | 9/2000 | Barrow | 182/127 |
| 6,378,654 | B1 | * | 4/2002 | Ziaylek et al. | 182/97 |
| 6,607,053 | B1 | * | 8/2003 | Warren | 182/106 |
| 6,986,402 | B2 | * | 1/2006 | Hedley et al. | 182/95 |
| 6,994,184 | B2 | * | 2/2006 | Latimer et al. | 182/77 |
| 7,721,849 | B2 | * | 5/2010 | Graffy et al. | 182/97 |
| 8,701,953 | B2 | * | 4/2014 | Bopp et al. | 224/547 |
| 2006/0042883 | A1 | * | 3/2006 | Scott | 187/351 |

FOREIGN PATENT DOCUMENTS

| | | | | | |
|---|---|---|---|---|---|
| JP | 10245170 | A | * | 9/1998 | B66B 5/00 |

* cited by examiner

*Primary Examiner* — Katherine Mitchell
*Assistant Examiner* — Candace L Bradford
(74) *Attorney, Agent, or Firm* — Lance Kreisman; Peninsula Patent Group

(57) ABSTRACT

A retractable ladder assembly for use in an elevator pit is disclosed. The retractable ladder assembly includes a ladder having spaced-apart parallel stiles coupled together via a plurality of stacked horizontally-disposed rungs. At least one pivot arm having a first end is coupled to the ladder. A second end of the pivot arm is adapted for coupling to a wall in the pit. The ladder assembly further includes a lift assist mechanism having a first end coupled to the ladder, and a second end for coupling to the wall. The lift assist mechanism is operative to assist in manually pivoting the ladder to a retractable state.

14 Claims, 2 Drawing Sheets

RETRACTABLE LADDER

RELATED APPLICATION(S)

This application claims benefit of priority to Provisional U.S. patent application Ser. No. 61/448,961, filed Mar. 3, 2011, the aforementioned priority application being hereby incorporated by reference in its entirety.

TECHNICAL FIELD

The disclosure herein relates to elevator services and structures, and more particularly a retractable elevator pit ladder.

BACKGROUND

Most if not all elevators have a hoistway area, commonly referred to as a pit, which extends some distance below the lowest landing served by an elevator. Such elevator pits commonly have a depth from three to seven feet or more. Access to the floor of the elevator pit is often required for inspection, maintenance and cleaning Most elevator pits do not have an access door as they are located below the grade of the structure. Traditionally, access to an elevator pit is accomplished through the elevator entrance at the lowest landing. With the elevator doors opened and the car moved out of the way, the technician climbs down a fixed and stationary ladder to the pit floor.

In some jurisdictions, applicable codes allow for an elevator pit ladder to have a reduced centerline of rung-to-wall or obstacle dimension of as little as 4.5 inches. Other jurisdictions require the centerline of rung-to-wall or obstacle dimension to be the full OSHA mandated 7 inches. On many new and existing elevator installations, there is insufficient clearance between the moving car and the building structure to fit a fixed, stationary ladder with the code-prescribed centerline of rung-to-wall or obstacle dimension.

Thus, the need exists for a retractable elevator pit ladder that can provide the code minimum centerline of rung-to-wall or obstacle dimension yet provide the necessary clearance to the operating elevator car.

BRIEF DESCRIPTION OF THE DRAWINGS

Embodiments of the disclosure are illustrated by way of example, and not by way of limitation, in the figures of the accompanying drawings and in which like reference numerals refer to similar elements and in which.

DETAILED DESCRIPTION

Embodiments of a retractable ladder assembly for use in an elevator pit are disclosed. In one embodiment, the retractable ladder assembly includes a ladder having spaced-apart parallel stiles coupled together via a plurality of stacked horizontally-disposed rungs. At least one pivot arm having a first end is coupled to the ladder. A second end of the pivot arm is adapted for coupling to a wall in the pit. The ladder assembly further includes a lift assist mechanism having a first end coupled to the ladder, and a second end for coupling to the wall. The lift assist mechanism is operative to assist in manually pivoting the ladder to a retractable state. Among other things, this configuration provides for ease of use while maintaining stringent building code requirements.

In another embodiment, the retractable ladder assembly includes at least one stile, the stile being formed with a deployment hole, at least one deployment arm, and a deployment mechanism mounted on the deployment arm. The deployment mechanism couples the deployment arm to the deployment hole. The deployment mechanism further includes an operating handle and a pin configured to detachably engage the deployment hole in the deployment arm in response to an activation of the operating handle.

Embodiments further provide for a ladder assembly having an electrical safety switch mechanism having a hinge pivot arm, and a switch including a biased plunger configured to slidably engage the hinge pivot arm to actuate the switch.

Figure 1:
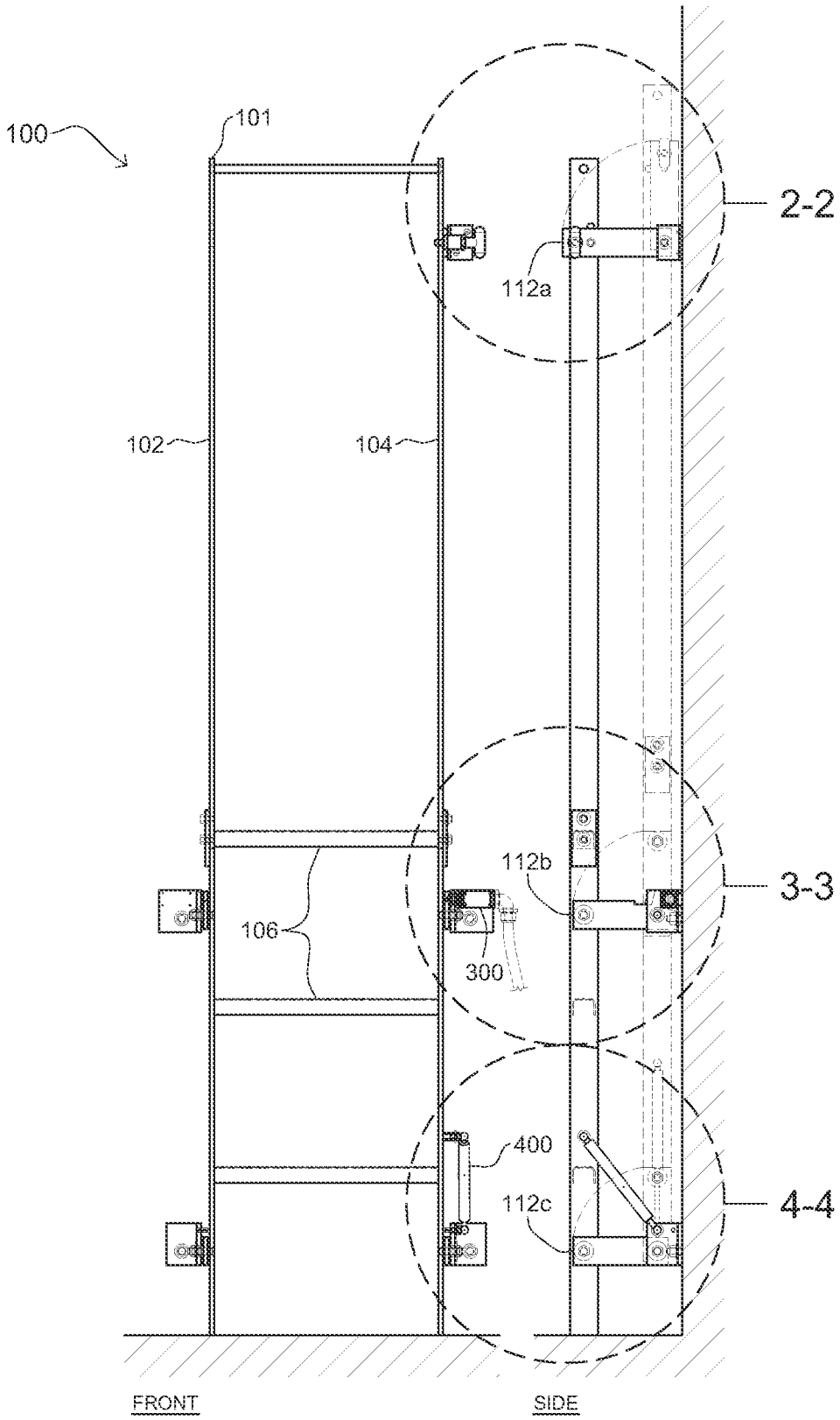
FIG. 1 illustrates one embodiment of a retractable elevator pit ladder in front and side elevation.

FIG. 1 illustrates a retractable ladder assembly, generally designated 100, in both front and side elevation perspectives. The ladder assembly includes a ladder 101 having a pair of parallel spaced-apart stiles 102 and 104 formed of a rigid metal, such as steel or aluminum. Ladder rungs 106 are interposed in a fixed relationship between the stiles in a regular stacked relationship. As more fully described below, the ladder assembly 100 includes a plurality of pivots 112*a*-112*c* to effect retractable operation of the ladder 101 with respect to a pit wall 110. The ladder assembly also includes a safety switch mechanism 300 and a lift assist mechanism 400, as more fully described below.

Figure 2:
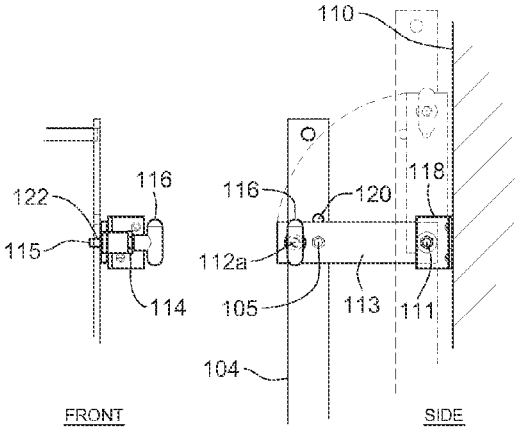
FIG. 2 illustrates a detail view of the area identified as 2-2 in FIG. 1, and showing a deployment pivot arm with a pull-pin deployment and locking mechanism.

Referring now to FIG. 2, additional details of one embodiment of a pivot 112*a* are shown. While only one pivot assembly is described below, it is to be understood that at least one pair of pivots are disposed on each stile of the ladder. Each pivot includes a rectangular shaped deployment pivot arm 113 having one end pivotably attached to a ladder stile 104, with pivot 105, while the other end is pivotably attached to a mount 118 attached to the pit wall 110 with pivot 111. A pull-pin deployment and locking mechanism 114 is mounted on the pivot arm, and includes a spring-loaded pin 115 having an operating handle 116 that detachably engages a first complementally-formed hole 120 in the stile 104 when in the "up", or retracted position, and locks the ladder in a deployed position by detachably engaging hole 122 with the ladder extended from the wall 110. The pull-pin deployment and locking mechanism is reversible with the ability to locate the mechanism on the opposite side of the ladder, which allows the ladder to be installed on either side of the elevator car. In an embodiment, a plurality of holes is provided on the stile and the pin may be detachably configured to deploy and engage each of the plurality of deployment holes in respective deployed and retracted states.

Figure 3B:
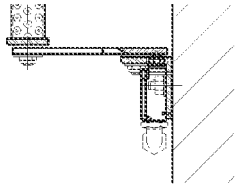
FIG. 3B illustrates a top plan view along lines 'A-A' of FIG. 3A.
Figure 3A:
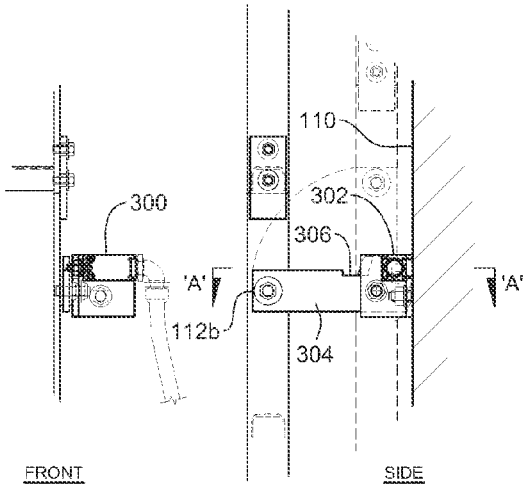
FIG. 3A illustrates a detail view of the area identified as 3-3 in FIG. 1, and showing a hinge pivot arm activated safety switch.

FIG. 3A illustrates further detail of one embodiment of the hinge pivot arm activated safety switch mechanism 300, shown in area 3-3 of FIG. 1. The safety switch mechanism, in one embodiment, includes a micro-switch that mounts to a platform on the wall 110 proximate one of the pivot assemblies 112*b*. The switch employs a biased plunger 302 that actuates switch contacts (not shown) to make or break electrical connection to an elevator power circuit when engaged in axial displacement (analogous to the locking pin mechanism described above). The plunger 302 includes a roller, and is depressible through lateral contact of a sliding beveled plate, such as a portion of the pivot arm 304. An opening 306 formed in the pivot arm is configured to align over the plunger while the ladder 101 is in a refracted position. Many of the features described above are also seen in FIG. 3B, which shows a top plan view along lines 'A-A' of FIG. 3A.

The unique beveling configuration of the pivot arm 304 cooperates with the location and design of the plunger 302 such that during deployment of the ladder 101, a portion of the pivot arm engages the roller plunger safety switch mechanism, effecting a forced open movement of the switch contacts. These contacts are wired in series with an elevator safety circuit, whereby an open circuit prevents the movement of the elevator car. The safety switch mechanism allows for the normal operation of the elevator car whilst the ladder is in the retracted position (phantom side view of FIG. 1) and prevents the operation of the elevator car whilst the ladder is in the deployed position. Embodiments provide for deploying the switch contacts in a closed position when the ladder is refracted.

Figure 4:
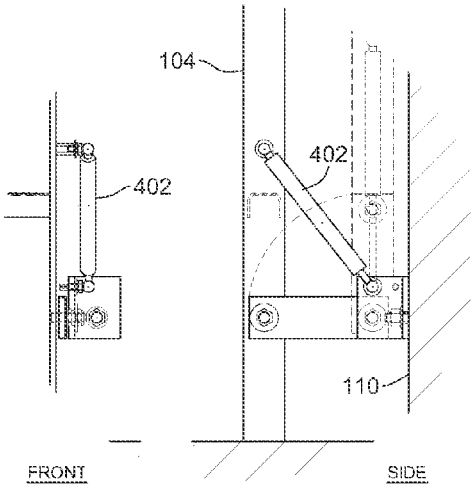
FIG. 4 illustrates a detail view of the area identified as 4-4 in FIG. 1, and showing a pneumatic spring-load assist mechanism.

FIG. 4 illustrates further detail regarding the lift assist mechanism of area 4-4 of FIG. 1. In one embodiment, the lift assist mechanism comprises a gas spring such as a piston-actuated air cylinder 402 that expands and contracts with a relatively stable level of resistance. One end of the cylinder couples to a ladder stile, such as that at 104, while the opposite end mounts to a support plate fixed to the pit wall 110. The cylinder beneficially reduces the amount of manual force required to retract and deploy the ladder.

In operation, a user desiring to access the elevator pit to perform servicing and/or repairs merely grasps the locking handle 116 to pull it out of its locked position and begin deployment of the ladder 101. With the ladder unlocked from its retracted position, the user exerts a small amount of force on the ladder outwardly from the wall. Although the ladder may weigh hundreds of pounds due to its heavy-duty metallic construction, the resistance provided by the air cylinder 402 enables a small amount of force from the user to deploy the ladder. As the pivot arms swing the ladder into a fully deployed vertical position, the locking mechanism 114 engages its locked position, and a portion of the medial pivot arm 304 slides over and depresses the switch plunger 302, thus actuating the switch contacts to cut power to the elevator service car. At this point, an elevator service-person may safely access the pit via the ladder to conduct the desired servicing and/or repair.

Once the servicing is complete, the user climbs back up the ladder, and from the elevator entrance, re-grasps the locking pin handle to free the locking pin from its locking hole. Once unlocked, a slight inwardly applied force from the user (assisted in large part by the pneumatic assist cylinder) is sufficient to pivotably bring the ladder 101 back to a retracted state against the pit wall. Once locked to the wall, the medial pivot arm opening releases the micro-switch plunger from its actuated position, thus restoring the switch contacts to their default state and allowing power back to the elevator car.

Those skilled in the art will recognize the various benefits and advantages afforded by the disclosure herein. The retractable ladder assembly is operable from the location of the elevator entrance, which is at the functional top of the ladder. Further, the assembly includes a unique mechanism of raising (retracting) and lowering (deploying) the ladder through the manual action of a user's single extended arm and hand. Moreover, the ladder assembly is capable of locking so as to maintain the ladder in either the retracted or deployed positions. Additionally, the assembly provides a switching device to prevent the movement of the elevator when the ladder is deployed (as it will be in the path of the moving car).

While the invention has been described with reference to specific embodiments thereof, it will be evident that various modifications and changes may be made thereto without departing from the broader spirit and scope of the invention. For example, features or aspects of any of the embodiments may be applied, at least where practicable, in combination with any other of the embodiments or in place of counterpart features or aspects thereof. Accordingly, the specification and drawings are to be regarded in an illustrative rather than a restrictive sense.

I claim:

1. A retractable ladder assembly comprising:

a ladder having first and second spaced-apart stiles, the first stile coupled to the second stile via multiple stacked horizontally-disposed rungs, the first stile formed with a pivot opening and a first opening offset from the pivot opening, the first stile further formed with a second opening offset from the pivot opening in a direction other than the first opening;

a first pivot received in the pivot opening to define a pivot point;

a pivot arm having a first end for pivotally mounting to an elevator pit wall mount, and a second end pivotally mounted to the first stile via the first pivot;

a pull-pin assembly mounted to the second end of the pivot arm, the pull-pin assembly having a user-grippable handle and a biased pin responsive to user actuation of the handle;

wherein in a retracted state, the first opening in the first stile receives the biased pin to lock the ladder in a retracted position with respect to the elevator pit wall; and wherein in an extended state, the second opening in the first stile receives the biased pin to lock the ladder in an extended position with respect to the elevator pit wall; wherein the first pivot is disposed proximate a top portion of the ladder; a second pivot opening formed proximate a bottom portion of the ladder; and a second pivot received in the second pivot opening; and wherein the second pivot includes a hinge pivot arm having one end mounted to a second elevator pit wall mount, and a second end; and an electrical safety switch mounted to the second end of the hinge pivot arm, the switch including a biased plunger configured to slidably engage the hinge pivot arm to actuate the switch.

2. The retractable ladder assembly of claim 1, wherein the first opening and the pivot opening are positioned along a line that runs parallel to a length of the first stile.

3. The retractable ladder assembly of claim 2, wherein the second opening and the pivot opening are positioned along a line that runs perpendicular to the length of the first stile.

4. The retractable ladder assembly of claim 3, wherein the first and second openings are oriented such that the biased pin traces an arc between the first opening and the second opening as the ladder changes state between the retracted state and the extended state.

5. The retractable ladder assembly of claim 1 wherein the switch further includes a set of contacts configured to maintain an open position responsive to the ladder being placed in a deployed position.

6. The retractable ladder assembly of claim 5, wherein the set of contacts are further configured to maintain a closed position responsive to the ladder being placed in an undeployed position.

7. The retractable ladder assembly of claim 1, further comprising:

a gas spring including a piston-actuated cylinder, wherein the cylinder includes a first end mounted to one of the first and second stiles, and a second end for mounting to the elevator pit wall.

8. An elevator pit comprising:

a pit wall oriented parallel to a path of an elevator car; and a retractable ladder assembly pivotally mounted to the pit wall via a wall mount, the retractable ladder assembly including a ladder having first and second spaced-apart stiles, the first stile coupled to the second stile via multiple stacked horizontally-disposed rungs, the first stile formed with a pivot opening and a first opening offset from the pivot opening, the first stile further formed with a second opening offset from the pivot opening in a direction other than the first opening;

a first pivot received in the pivot opening to define a pivot point;

a pivot arm having a first end mounted to the elevator pit wall mount, and a second end pivotally mounted to the first stile via the first pivot;

a pull-pin assembly mounted to the second end of the pivot arm, the pull-pin assembly having a user-grippable handle and a biased pin responsive to user actuation of the handle;

wherein in a retracted state, the first opening in the first stile receives the biased pin to lock the ladder in a retracted position with respect to the elevator pit wall; and wherein in an extended state, the second opening in the first stile receives the biased pin to lock the ladder in an extended position with respect to the elevator pit wall; wherein the first pivot is disposed proximate a top portion of the ladder; a second pivot opening formed proximate a bottom portion of the ladder; and a second pivot received in the second pivot opening; and wherein the second pivot includes a hinge pivot arm having one end mounted to a second elevator pit wall mount, and a second end; and an electrical safety switch mounted to the second end of the hinge pivot arm, the switch including a biased plunger configured to slidably engage the hinge pivot arm to actuate the switch.

9. The elevator pit of claim 8, wherein the first opening and the pivot opening are positioned along a line that runs parallel to a length of the first stile.

10. The elevator pit of claim 9, wherein the second opening and the pivot opening are positioned along a line that runs perpendicular to the length of the first stile.

11. The elevator pit of claim 9, wherein the first and second openings are oriented such that the biased pin traces an arc between the first opening and the second opening as the ladder changes state between the retracted state and the extended state.

12. The elevator pit of claim 8 wherein the switch further includes a set of contacts configured to maintain an open position responsive to the ladder being placed in a deployed position.

13. The elevator pit of claim 8, further comprising:

a gas spring including a piston-actuated cylinder, wherein the cylinder includes a first end mounted to one of the first and second stiles, and a second end for mounting to the elevator pit wall.

14. A method of operating a retractable ladder of claim 1 in an elevator pit that receives a ladder, the ladder including respective first and second stiles, the first stile formed with first and second openings offset from a pivot opening, the method comprising:

extending the ladder by releasing the ladder from a locked, retracted state, the releasing carried out in response to pulling a pull-pin via a user-grippable handle and allowing the ladder to extend outwardly from a wall of the elevator pit;

assisting in extending the ladder via a gas spring coupled to the elevator pit wall and the ladder;

locking the ladder in an extended state, the locking comprising receiving the pull-pin in the first opening as the ladder reaches the extended state; and opening a safety circuit of the elevator via a biased plunger as the ladder transitions from a retracted, locked state, to an extended, locked state.

* * * * *